Fig-1-
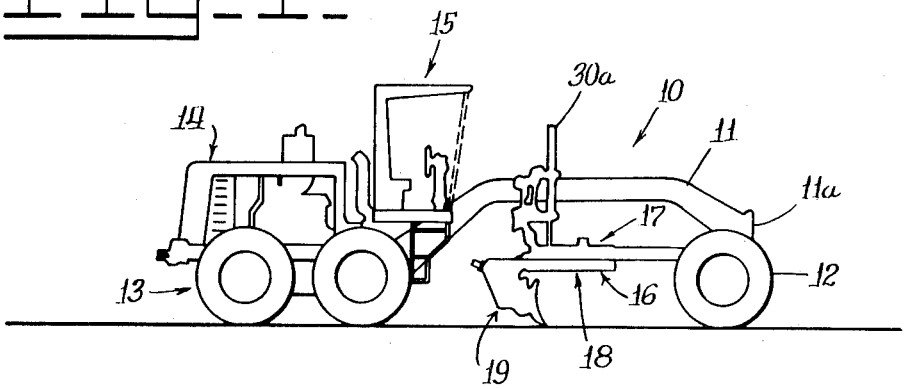
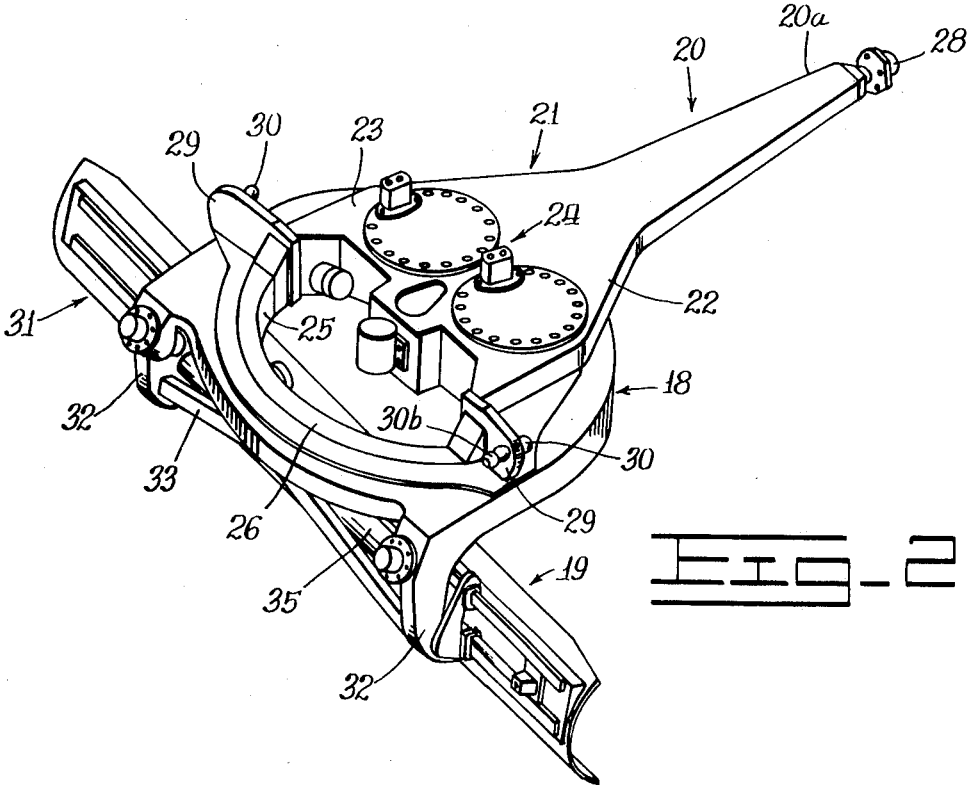
Fig-2-

United States Patent [19]

Cole

[11] 4,074,767

[45] Feb. 21, 1978

[54] MOTOR GRADER SUPPORT STRUCTURE AND SIDE SHIFT MECHANISM

[75] Inventor: Carroll Richard Cole, Decatur, Ill.

[73] Assignee: Caterpillar Tractor Co., Peoria, Ill.

[21] Appl. No.: 696,163

[22] Filed: June 14, 1976

[51] Int. Cl.[2] ..... E02F 3/76

[52] U.S. Cl. ..... 172/781; 172/741; 172/745; 172/795

[58] Field of Search ..... 172/272, 273, 274, 275, 172/305, 476, 507, 667, 673, 719, 741, 743, 745, 747, 767, 781, 782, 789, 791, 792, 793, 795, 796, 797; 214/138 C, 145 A; 280/456 R, 460 R, 461 R; 403/110

[56] References Cited

U.S. PATENT DOCUMENTS

| | | | |
|---|---|---|---|
| 2,799,099 | 7/1957 | Leliter | 172/667 |
| 3,117,685 | 1/1964 | Davis | 214/138 C |
| 3,444,936 | 5/1969 | Page et al. | 172/795 |
| 3,448,816 | 6/1969 | Beals et al. | 172/793 |
| 3,454,107 | 7/1969 | Schiavi | 172/719 |
| 3,463,243 | 8/1969 | Fisher | 172/781 |
| 3,465,829 | 9/1969 | Fisher et al. | 172/743 |
| 3,677,350 | 7/1972 | Johnson et al. | 172/789 |
| 3,921,728 | 11/1975 | Casey | 172/745 |

*Primary Examiner*—Richard T. Stouffer
*Attorney, Agent, or Firm*—Wegner, Stellman, McCord, Wiles & Wood

[57] ABSTRACT

An improved support for mounting the grader blade assembly of a motor grader on depending support arms of the motor grader circle. A bearing housing structure which is several times wider than the height of the blade assembly consists of a transverse hollow structural member with integral upright bearing housings at its ends which are substantially wider than and pivoted on the arms so the structure may be tilted. Forwardly open lower jaws in the bearing housings have planar top and rear surfaces and front lower webs which are generally complementary to surfaces of a lower support rail on the blade assembly; and forwardly open upper jaws provide upper and lower front webs and a planar rear surface which are generally complementary to surfaces of an upper support rail on the blade assembly. Working forces are transmitted from the rails through the jaws and bearing housings to the support arms; and vertical forces are transmitted almost exclusively through the lower jaw. A hydraulic cylinder and piston unit for shifting the blade assembly endwise is mounted in the hollow structural member of the bearing housing structure and is removable therefrom endwise.

23 Claims, 10 Drawing Figures

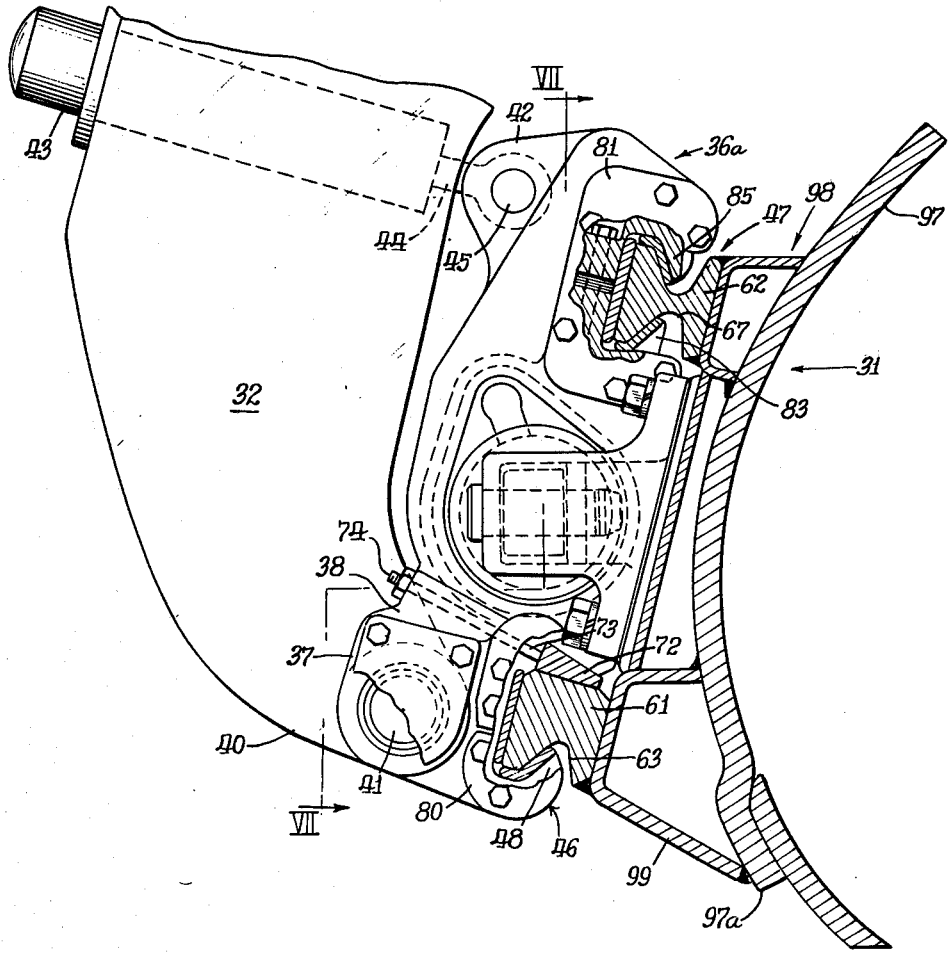

Fig-3-
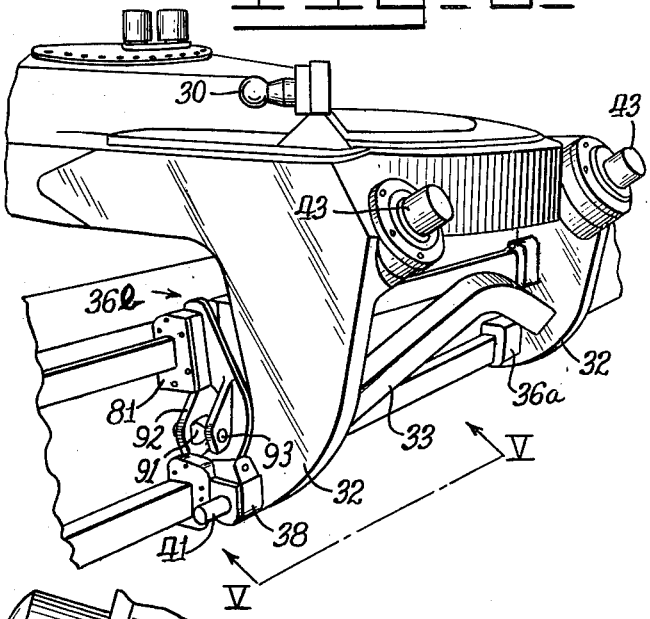
Fig-5-
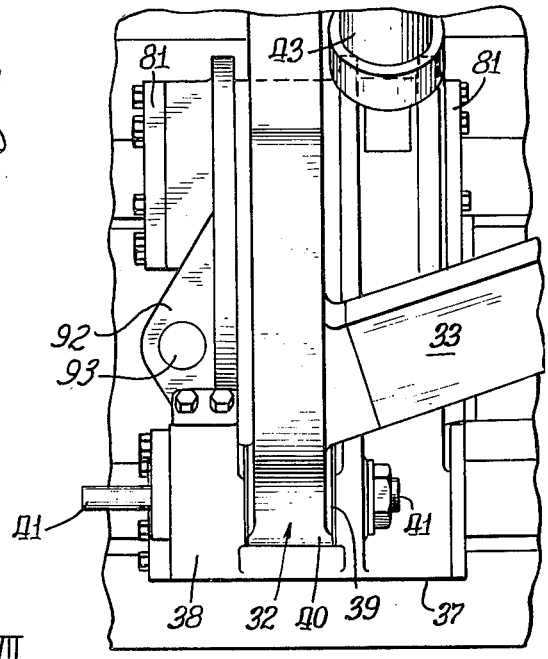
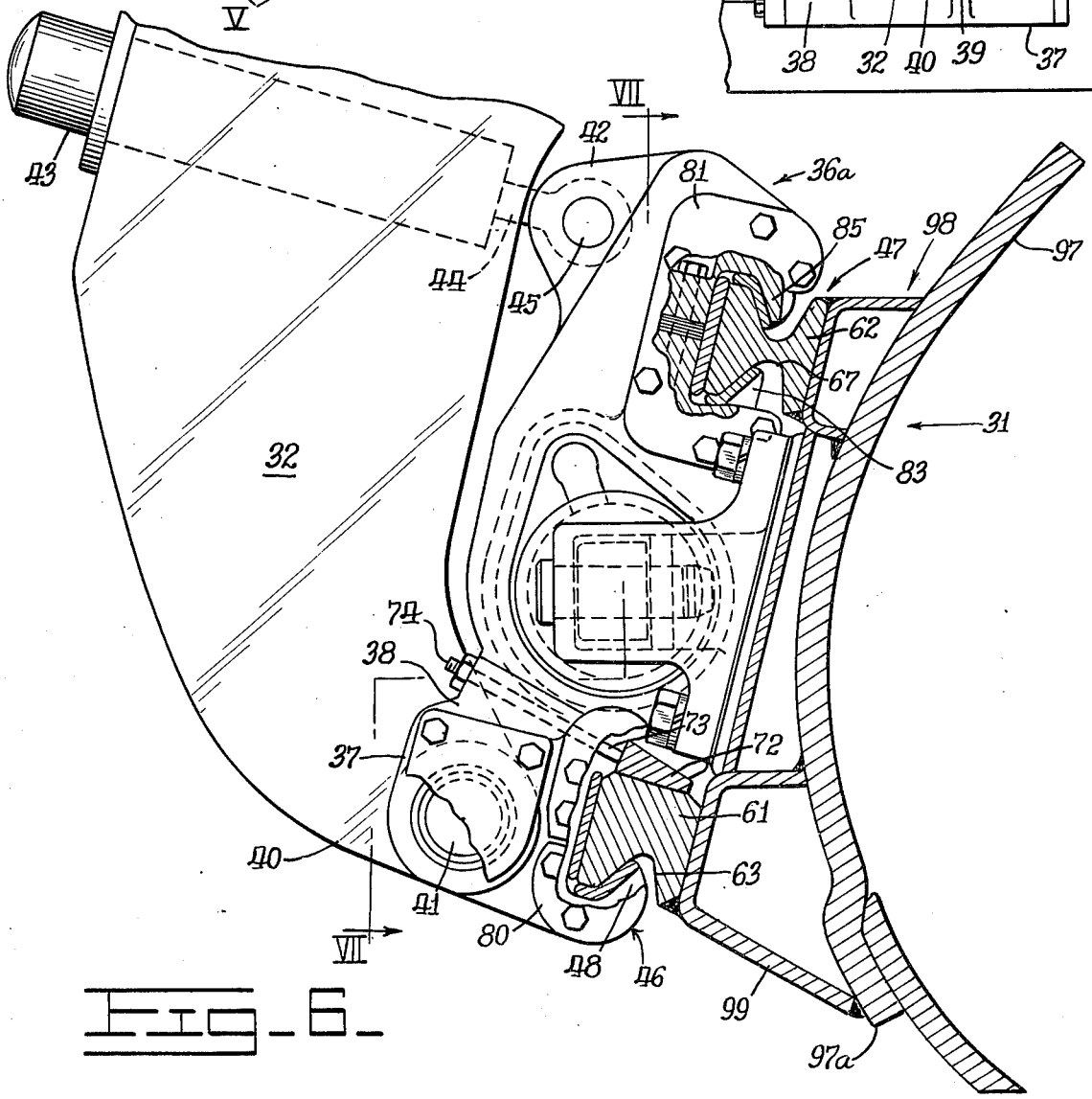
Fig-6-

MOTOR GRADER SUPPORT STRUCTURE AND SIDE SHIFT MECHANISM

CROSSREFERENCE TO RELATED APPLICATIONS

Details of the draw bar structure and of the circle mounting bar and circle assembly which are illustrated and described generally in this application are described in detail and claimed in copending U.S. patent applications of Carroll Richard Cole, Ser. No. 661,880, filed Feb. 27, 1976 and Ser. No. 663,594, filed Mar. 3, 1976, now U.S. Pat. No. 4,015,669.

The blade structure which is illustrated and described generally in this application is described in detail and claimed in applicant's U.S. patent application Ser. No. 696,161, filed June 14, 1976, now abandoned.

The blade mounting adjustable, lower wear strip mounting and floating upper wear strip mounting which are disclosed on this application are disclosed and claimed in copending U.S. patent application of Richard Allan Atherton and Carroll Richard Cole, Ser. No. 696,097, filed June 14, 1976, now U.S. Pat. No. 4,058,174.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade and it may also be shifted endwise in its mounting.

U.S. Pat. Nos. 2,799,099, 3,444,936, 3,465,829, and 3,677,350 disclose typical prior art structures for mounting a motor grader blade assembly on the support arms of the circle for tilting movement and for endwise sliding movement.

SUMMARY OF THE INVENTION

The principal object of the present invention is to provide an improved support means for mounting the grader blade assembly of a motor grader on the support arms of the motor grader circle.

Another object of the invention is to provide a structure in which a bearing housing structure has a transverse structural member with upright bearing housings at its ends with the span across the entire structure being several times greater than the height of the grader blade assembly so as to substantially eliminate tilting of the grader blade assembly in the support structure.

Still another object of the invention is to provide a structure in which the housings are considerably wider than the support arms and are straddle mounted upon the support arms to provide extremely wide bearing surfaces between the supporting structure and the support rails of the blade structure.

Yet another object of the invention is to provide an improved support structure in which the bearing housings have forwardly open upper and lower jaws which are provided with upstanding forward bottom webs that are received in generally complementary longitudinal channels in the support rail and in which complementary confining surfaces at the rear and upper portions of the jaws and the support rail retain the latter in the jaws for endwise sliding movement.

Yet another object of the invention is to provide a structure in which the forwardly open upper jaws have depending upper front webs which are received in a generally complementary top channel in the top of the upper support rail.

Still another object of the invention is to provide a structure which cooperates with the support rails of a grader blade assembly to transmit vertical working forces alomst entirely through the lower rail and the lower jaws of the bearing housings; and which cooperates with said rails to distribute all working forces over relatively large areas.

Yet another object of the invention is to provide a structure in which a hydraulic cylinder and piston unit for side shifting the grader blade assembly on its mounting is carried in the hollow structural member of the bearing housing structure where it is protected from damage by earth and rocks which go over the top of the grader blade moldboard.

THE DRAWINGS

FIG. 1 is a side elevational view of a motor grader embodying the invention;

FIG. 2 is a perspective view of a subassembly consisting of a circle mounting bar, a circle, and a grader blade assembly and improved grader blade support and bearing means which embodies the present invention;

FIG. 3 is a fragmentary perspective view of an enlarged scale taken from the side opposite FIG. 2;

FIG. 5 is a fragmentary rear elevational view on a further enlarged scale taken substantially as indicated along the line V—V of FIG. 3;

FIG. 6 is a longitudinal sectional view on an enlarged scale, with parts broken away, taken substantially as indicated along the line VI—VI of FIG. 4;

DETAILED DESCRIPTION OF THE INVENTION

Figure 4:
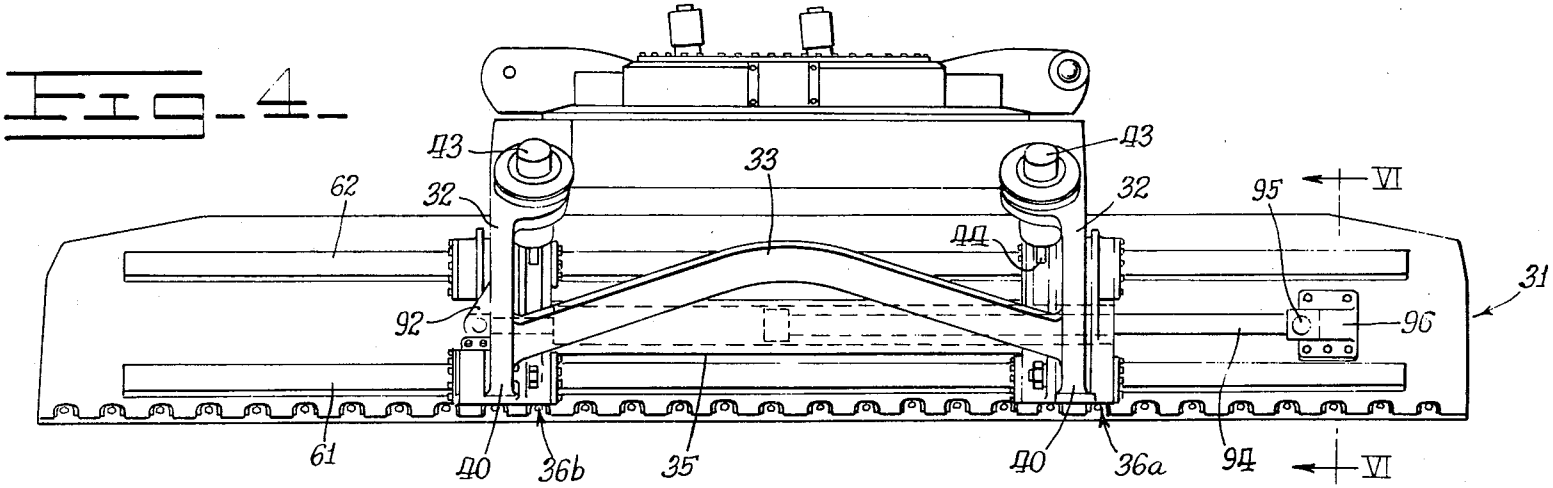
FIG. 4 is a rear elevational view of the apparatus on an enlarged scale, with the blade assembly in a first position.

Referring first to FIG. 1 of the drawings, a motor grader, indicated generally at 10, includes a longitudinal main frame 11 the front end 11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19.

The circle draw bar 17 is best seen in FIG. 2 to include a forward beam, indicated generally at 20, and a rearward circle carrying structure, indicated generallly at 21, the forward part 22 of which is integral with the rear end of the beam 20. Behind the part 22 of the carrying structure said carrying portion has a section 23 the depth of which is great enough that it forms a housing extending below the circle 18. The housing section 23 receives drive means, indicated generally at 24. The housing section 23 of the circle draw bar merges into a nearly semi-annular upright wall 25 which is part of an internal housing for the circle 18, and integral with the wall 25 is a horizontal top wall 26.

The subassembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 30*a* which are carried upon the main frame 11. Thus, operation of the hydraulic cylinder units 30*a* swings the circle draw bar 17 about the ball and socket connection including the ball 28, which in this respect provides a horizontal pivot axis. A ball 30*b* on one of the webs 29 provides for a ball and socket connection with a side-shift cylinder (not shown) which shifts the draw bar sideways, with the ball 28 providing a vertical pivot axis.

Referring now particularly to FIGS. 3 to 7, the grader blade and blade mounting 19 includes a grader blade assembly, indicated generally at 31, which is carried in blade support arms 32 that are integral with the rear portion of circle structure 18 and that are connected by a hollow square reinforcing beam 33. A bearing housing structure, indicated generally at 34, consists of a transverse hollow structural member 35 which has substantially upright bearing housings, indicated generally at 36*a* and 36*b*, at its two ends. The bearing housings are essentially mirror images of one another, but are not identical.

As best seen in FIGS. 5 and 6 each housing includes a frame 37 which is substantially wider than the support arm 32, and the lower portion 38 of the frame 37 is bifurcated as seen at 39 so as to straddle the lower end portion 40 of the support arm 32; and a pivot pin 41 impales the bifurcated part of the body 37 and the straddled lower end portion 40 of the support arm 32 so that the housing structure 34 is pivoted on the arms 32 and is forward of said arms.

At the upper, rear portions of the housings 36 are parallel webs 42, and hydraulic cylinder units 43 which are mounted upon the support arms 32 have piston rods 44 which extend between the webs 42 and are pivotally connected thereto by pins 45, so that operation of the hydraulic cylinder units 43 swings the bearing housing structure 34 about the pivot pins 41.

Figure 8:
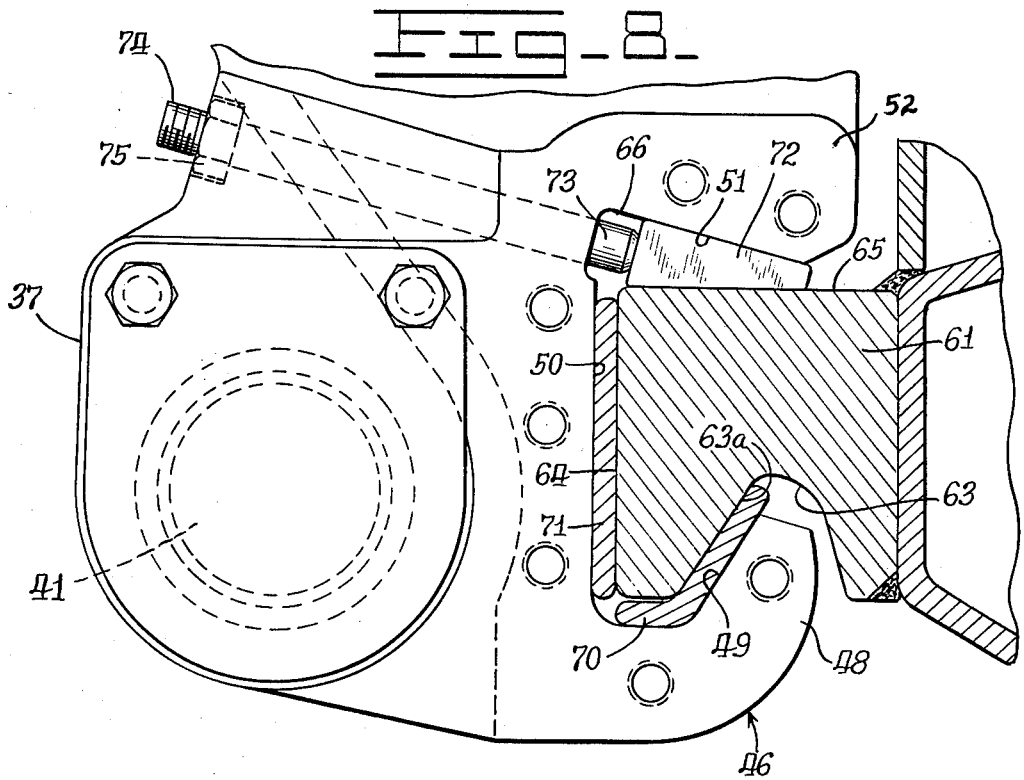
FIG. 8 is an enlarged fragmentary view of the lower portion of FIG. 6.
Figure 9:
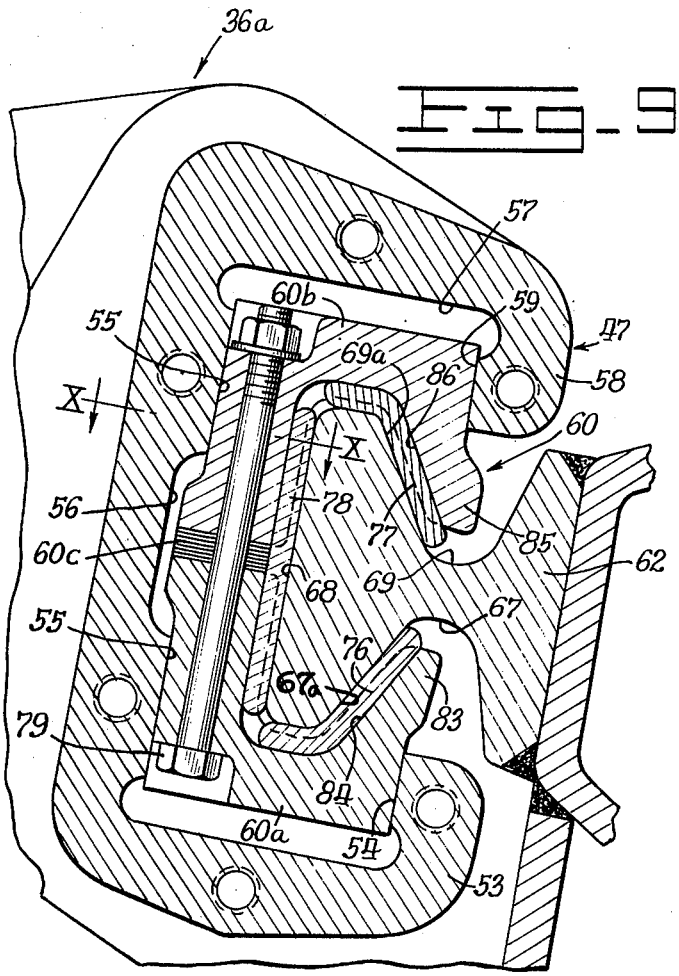
FIG. 9 is an enlarged fragmentary view of the upper part of FIG. 6.
Figure 10:
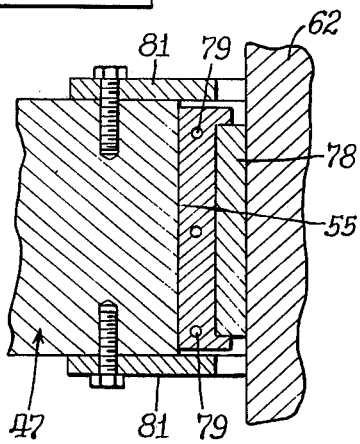
FIG. 10 is a fragmentary transverse sectional view on a reduced scale taken substantially as indicated along the line X—X of FIG. 9.

Referring now to FIGS. 6, 8 and 9, each of the bearing housings 36*a* and 36*b* has, in the forward part of its lower portion 37, a forwardly open fixed lower jaw, indicated generally at 46; and in the upper portion of each housing is a forwardly open fixed upper jaw, indicated generally at 47. Each of the lower jaws is defined by a lower front web 48 which has an inclined inner surface 49; a vertical back surface 50; and extending forwardly and downwardly from the upper end of the back surface 50 is an inclined surface 51 of a top portion 52 of said lower jaw.

The upper jaw 47 is defined by a front lower web 53 which has a vertical rear face 54; a vertical rear surface 55 which is interrupted by an intermediate recess 56; a forwardly extending top jaw surface 57; and a depending front upper web 58 that has a vertical rear surface 59 aligned with the vertical surface 54 of the bottom web 53. Thus, the surfaces 54 and 59 provide a discontinuous guide which is parallel to the surfaces 55; and a wear strip carrier, indicated generally at 60, is slidably mounted in each of said upper jaws 47 between the surfaces 54–59 and the surface 55.

The grader blade assembly 31 has a moldboard 97 and reinforcing means defining a box-like structure 98 which has a bottom web 99 close to the bottom 97*a* of the moldboard. A support rail 61 directly behind the web 99 fits loosely in the lower jaw 46, and has a longitudinal bottom channel 63, a planar back surface 64, and a planar top surface 65 which cooperates with the surface 51 of the lower jaw top portion 52 to define a cavity 66 which is substantially shallower from top to bottom at the front than it is at the rear.

An upper support rail 62 which fits loosely in the carrier 60 has a longitudinal bottom channel 67 which is identical with the channel 63 in the rail 61, and it also has a planar rear face 68 and a top channel 69 which is opposite to and identical with the channel 67.

Anti-friction wear strips line the lower jaw 46, and include a bottom wear strip 70 which seats against the rear surface 49 of the lower front web 48, and also against the bottom of the jaw, and a rear wear strip 71 fills the space between the planar rear jaw surface 50 and the planar rear support rail surface 64. Finally, a wedge shaped wear block 72 is mounted in the cavity 66, and an adjusting stud 73 is carried in a bore in the rear portion of the housing member 36*a* and has a threaded outer end portion 74 which threadedly engages a captive nut 75 mounted in the housing so that the stud may be adjusted longitudinally and thus change the position of the wear block 72 as necessary to maintain a close sliding fit of the lower support rail 61 in the wear strips and the wear block.

Mounted in the wear strip carrier 60 are a lower wear strip 76, an upper wear strip 77, and a back wear strip 78; and in order to maintain a snug sliding fit of the upper support rail 62 in the wear strips 76, 77 and 78 the wear strip carrier 60 consists of a lower part 60*a* and an upper part 60*b*, plus a set of shims 60*c* and assembly bolts and nuts 79 which impale the two parts of the wear strip carrier and the shims.

All of the wear strips are preferably of Teflon or some other very low friction plastic material which requires no lubrication. Before the grader blade is mounted, the upper wear strip carriers 60 with their wear strips 76, 77 and 78 are mounted upon the upper support rail 62; and the wear strips 70 and 71 of the lower jaws 46 are set in the jaws and are lightly secured with adhesive. The grader blade is then moved endwise to position its lower support rail 61 as seen in FIG. 8 and to position the upper support rail 62 and the wear strip carrier 60 as seen in FIG. 9. The wedge shaped block 72 is then moved endwise into the cavity 66 and the adjusting stud 73 is adjusted inwardly until there is a close sliding fit of the bottom support rail 61 in the lower jaw wear strips. Retainer plates 80 which loosely embrace the rearward portion of the bottom support rail 61, and top retainer plates 81 which loosely embrace the rearward portion of the top support rail 62 are then fastened to the housings 37 by means of machine screws which threadedly engage bores that surround the lower jaws and the upper jaws.

As is apparent from FIG. 9, the upper wear strip carriers 60 are free to slide up and down in the upper jaws 47, and this permits free lateral adjustment of the grader blade assembly even if the lower support rail 61 and the upper support rail 62 are not absolutely parallel. This is an important feature of the structure, since it is extremely difficult to achieve perfect parallelism when mounting a pair of rails which must be welded in place.

Referring now to FIGS. 8 and 9, it is seen that the wear strip carrier 60 has a lower front flange 83 with an inclined rear face 84 so that the lower portion of the carrier is just like the lower portion of the lower jaw 46, and respective inclined faces 63*a* of the lower rail bottom channel 63 and 67*a* of the upper rail bottom channel 67 are complementary to the surfaces 49 and 84. In addition, the wear strip carrier 60 also has an upper front flange 85 which has an inclined rear face 86, and the upper rail top channel 69 has an inclined face 69*a* which is complementary to said face 86. Thus, the wear strips 70 and 71 and the wear block 72 essentially envelop the lower rail 61, and the wear strips 76, 77 and 78 essentially envelop the upper rail 62. This, combined with the large lateral span of the bearing housing 36*a* and 36*b*, provides for relatively very low bearing pressures between the rails, the wear strips and the lower jaw 46 and the upper jaw 47 and carrier 60, thus permitting the use of plastic wear strips which can tolerate only limited bearing pressures.

Figure 7:
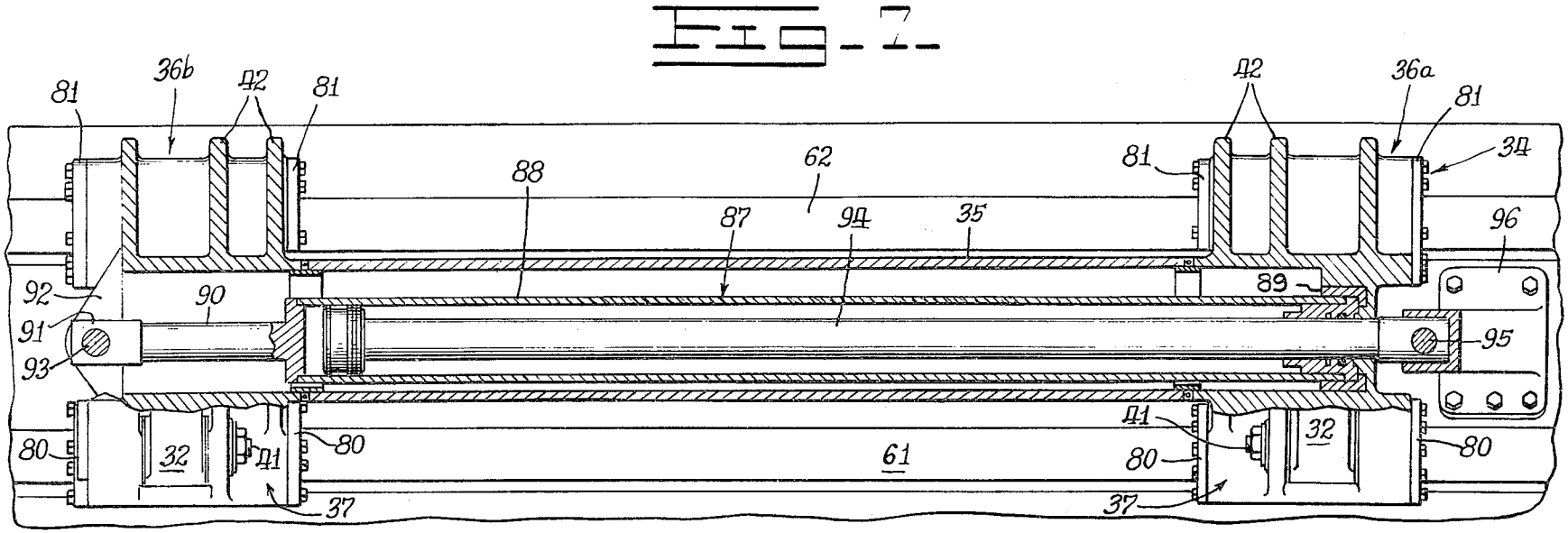
FIG. 7 is a fragmentary sectional view on a reduced scale taken substantially as indicated along the line VII—VII of FIG. 6 with the blade assembly shifted to the left as compared with FIG. 4.

Referring now particularly to FIG. 7, it is seen that the hollow, longitudinal structural member 35 provides a housing for a cylinder and piston unit, indicated generally at 87, by means of which the grader blade assembly 31 is adjusted endwise in the support arms 32 and bearing housings 36*a* and 36*b*. A cylinder 88 of the unit 87 has a forward end carried in a flanged collar 89 that seats in a recess in the bearing housing 36*a*; while the rear of the cylinder 88 is provided with a mounting stud 90 having an outer end portion 91 that is positioned between a pair of spaced, parallel webs 92 that are integral with the housing 36*b*, so that a pin 93 may be used to secure the end of the unit 87. The space between the webs 92 is greater than the maximum diameter of the cylinder 88. A piston rod 94 of the unit 87 has a pin 95 at its outer end by means of which it is pivotally connected to a bracket 96 on the back of the grader blade assembly 31. Thus, when pressure is applied to the head end of the rod 94 the rod is moved from the position of FIG. 7 to the position of FIG. 4 and thus slides the grader blade assembly 31 to the right as seen in those views.

Mounting the cylinder and piston unit 87 in the hollow structural member 35 protects it from damage, and yet the entire unit is easily removed for replacement or repair by removing the pins 93 and 95 and sliding the unit endwise between the webs 92.

The foregoing detailed description is given for clearness of understanding only and no unnecessary limitations should be understood therefrom as modifications will be obvious to those skilled in the art.

What is claimed is:

1. In a motor grader which has a circle with a pair of integral, depending blade support arms at its rearward portion, an improved support means for mounting a grader blade assembly on said arms for endwise movement, said improved means comprising, in combination:

a unitary bearing housing structure comprising a transverse structural member which is entirely between the blade support arms and has a generally upright bearing housing integrally connected thereto at each of its ends between the support arms;

pivot means operatively associated with said housings independently of and spaced from said structural member, said pivot means mounting said structure on said support arms and forward of the arms, said housings having open upper jaws and open lower jaws extending entirely across them;

and substantially parallel upper and lower support rails on the rear of the blade assembly which extend through said jaws and are slidable therein, said jaws and support rails having slidably interengaging surfaces to retain the support rails in the jaws.

2. The combination of claim 1 in which the bearing housings are substantially wider than the support arms, the lower end portions of the housings are bifurcated and straddle the lower end portions of the support arms, and the means mounting the structure on the support arms comprises a transverse pin impaling the lower end portion of each housing and the straddled portion of the support arm, and which includes means for tilting the housing structure about said transverse pins.

3. The combination of claim 1 in which the span across the bearing housing structure is substantially greater than the height of the blade.

4. The combination of claim 3 in which the span across the bearing housing structure is in excess of four times the height of the blade.

5. The combination of claim 1 in which the slidably interengaging surfaces of the jaws and support rails comprise an upstanding lower web extending continuously across the front lower part of each jaw, and a generally complementary bottom channel in the lower part of each support rail into which said lower webs extend, and laterally continuous rearward and upper confining surfaces in the jaws to which corresponding surfaces of the support rails are generally complementary.

6. The combination of claim 5 in which the lower webs are generally wedge shaped in cross section with inclined rear faces, and the bottom channels in the rails have rear surfaces which match said inclined rear faces of the lower webs.

7. The combination of claim 5 in which there is a depending upper web extending continuously across the front upper portion of each upper jaw, and a generally complementary top channel in the top of the upper support rail receives said upper webs.

8. The combination of claim 7 in which the upper webs are generally wedge shaped in cross section with inclined rear faces, and the top channel has a rear surface which matches said inclined rear faces of the upper webs.

9. The combination of claim 8 in which the lower webs are generally wedge shaped in cross section with inclined rear faces, and the bottom channels in the rails have rear surfaces which match said inclined rear faces of the lower webs.

10. The combination of claim 5 in which the lower jaws have planar upper confining surfaces overlying a planar top surface of the lower rail, so that vertical working forces on the blade may be transmitted preponderantly through said planar surfaces.

11. The combination of claim 10 in which the planar upper confining surfaces and the planar top surface have abutting areas of substantial extent.

12. The combination of claim 1 in which the lower support rail has a planar top surface and a planar back surface each of which is of substantial area, and the lower jaws have planar upper confining surfaces overlying said top surface and planar rear confining surfaces complementary to said back surfaces, said confining surfaces extending for substantial distances along said rails.

13. The combination of claim 1 in which the transverse structural member is hollow and has open ends aligned with openings in the bearing housings, a side shift hydraulic cylinder unit is mounted in the structural member, a mounting member on the cylinder of said unit is pivotally connected to one of the bearing housings, and a piston rod of said unit is pivotally connected to a bracket on the back of the blade assembly.

14. The combination of claim 13 in which said one of the bearing housings has a pair of parallel webs, a pin is removably mounted in said webs, and the mounting member on the cylinder is pivotally connected to said pin, whereby removal of the pin and detachment of the piston rod from its pivotal connection permits the cylinder unit to be removed endwise from the structural member.

15. In a motor grader which has a circle and a pair of depending blade support arms at the rear of the circle, an improved grader blade assembly and support comprising, in combination:

a grader blade assembly which includes a moldboard and reinforcing means welded to the rear of the moldboard and defining therewith a box-like structure that has a lower web substantially along the bottom margin of the moldboard, a lower support rail extending along and secured by a weld to said box-like structure at a location thereon directly to the rear of said lower web, said lower support rail having a planar top surface substantially normal to the box-like structure, the front of said top surface being immediately adjacent said weld and said planar top surface extending effectively uninterruptedly from said front to a rear surface of the rail, and said rail having a bottom portion with a longitudinal bottom channel formed therein, and an upper support rail extending along and welded to the upper portion of said box-like structure;

and upstanding blade support means including two bearing housings, mounting means at the lower end of each of said housings mounting them on the lower ends of the blade support arms forward of the arms, each of said housings having a forwardly open lower jaw close to said mounting means in which the lower rail is supported for endwise movement, each of said lower jaws having a continuous planar confining surface which extends substantially the entire distance from the front to the rear of the planar top surface of the lower support rail and for a substantial distance therealong, and said jaw having a front lower web extending into the bottom channel of said lower support rail, and each of said housings also having forwardly open upper jaws in which the upper support rail is confined for endwise movement, whereby vertical working forces are transmitted principally through the lower rail and said upper confining surfaces with insignificant torque about the mounting means.

16. The combination of claim 15 in which the top rail has a bottom portion with a longitudinal bottom channel, and front lower webs in the upper jaws extend into said last named bottom channel.

17. The combination of claim 16 in which the lower rail and the upper rail have planar back surfaces of substantial area; and the lower and upper jaws provide rear confining surfaces complementary to said back surfaces.

18. The combination of claim 17 in which the webs and the confining surfaces of the jaws extend for substantial distances along the rails.

19. The combination of claim 15 in which the lower rail and the upper rail have planar back surfaces of substantial area; and the lower and upper jaws provide rear confining surfaces complementary to said back surfaces.

20. The combination of claim 15 in which the mounting means comprises aligned transverse pivots, and which includes tilting means connected to the circle and to the upper parts of the housings immediately adjacent the open upper jaws, so that working forces transmitted through the upper support rail are carried into said tilting means with little torque.

21. The combination of claim 20 in which the transverse pivots are substantially directly to the rear of the open lower jaws.

22. The combination of claim 14 in which the parallel webs are in planes flanking a projection of the cylinder, whereby the cylinder unit may be removed endwise between said webs.

23. In a motor grader which has a circle and a pair of depending blade support arms at the rear of the circle, an improved grader blade assembly and support comprising, in combination:

a grader blade assembly which includes a moldboard and reinforcing means welded to the rear of the moldboard which extends substantially from end to end of the moldboard and which includes a lower element substantially along the bottom margin of the moldboard and an upper element on the upper portion of the moldboard, a lower support rail extending along and secured by a weld to said reinforcing means at a location thereon directly to the rear of said lower elements, said lower support rail having a planar top surface substantially normal to the box-like structure, the front of said top surface being immediately adjacent said weld and said planar top surface extending effectively uninterruptedly from said front to a rear surface of the rail, and said rail having a rear surface of substantial height and a bottom portion that has a longitudinal bottom channel formed therein, and an upper support rail extending along and welded to the reinforcing means at a location thereon adjacent said upper element, said upper support rail having a rear surface of substantial height and having top and bottom surfaces which are of substantial depth from front to rear and have longitudinal channels formed therein;

upstanding blade support means including two bearing housings, aligned transverse mounting pivots mounting each of said housings on the lower end of one of the blade support arms forward of the arm, each of said housings having a forwardly open lower jaw immediately forward of and substantially in the horizontal plane of the pivots and having a forwardly open upper jaw, said lower and upper support rails being confined for endwise movement in said lower and upper jaws, respectively, and said lower and upper jaws providing continuous bearing surfaces which extend a substantial distance along the rear rail surfaces and along the top surface of the lower rail, and having flanges engaged in said channels;

and tilting means mounted on the circle and pivotally connected to the upper parts of the housings immediately to the rear of the upper jaws, whereby working forces on the blade are transmitted to the circle with insignificant torque about the mounting pivots and on the tilting means.

* * * * *